United States Patent [19]

Yamakawa

[11] Patent Number: 5,007,751

[45] Date of Patent: Apr. 16, 1991

[54] PRINTER HAVING CARRIAGE ZEROING DEVICE

[75] Inventor: Kiyoshi Yamakawa, Gifu, Japan

[73] Assignee: Brother Kogyo Kabushiki Kaisha, Japan

[21] Appl. No.: 256,971

[22] Filed: Oct. 13, 1988

[30] Foreign Application Priority Data

Oct. 16, 1987 [JP] Japan ..... 62-262507

[51] Int. Cl.[5] ..... B41J 19/30

[52] U.S. Cl. ..... 400/322; 400/320; 400/279

[58] Field of Search ..... 400/279, 314.3, 320, 400/322, 329.1, 337, 341, 345, 705, 705.1, 903

[56] References Cited

U.S. PATENT DOCUMENTS

| | | | |
|---|---|---|---|
| 3,670,861 | 6/1972 | Zenner et al. | 400/903 X |
| 4,024,447 | 5/1977 | Epstein | 400/903 X |
| 4,024,941 | 5/1977 | Sekikawa et al. | 400/903 X |
| 4,034,842 | 7/1977 | Giacone | 400/322 X |
| 4,044,882 | 8/1977 | Weinke et al. | 400/903 X |
| 4,669,900 | 6/1987 | Miyake et al. | 400/322 |
| 4,706,008 | 11/1987 | Cronch et al. | 400/903 X |
| 4,714,361 | 12/1987 | Yamakawa | 400/322 |

FOREIGN PATENT DOCUMENTS

| | | | |
|---|---|---|---|
| 0161682 | 12/1980 | Japan | 400/903 |
| 0060286 | 5/1981 | Japan | 400/705.1 |
| 174291 | 10/1982 | Japan | 400/903 |
| 0007386 | 1/1983 | Japan | 400/903 |
| 0219079 | 12/1983 | Japan | 400/903 |
| 0074874 | 4/1986 | Japan | 400/903 |
| 185479 | 8/1986 | Japan | 400/64 |
| 0227076 | 10/1986 | Japan | 400/322 |
| 0237677 | 10/1986 | Japan | 400/903 |
| 0005870 | 1/1987 | Japan | 400/903 |
| 0013374 | 1/1987 | Japan | 400/903 |
| 0077967 | 4/1987 | Japan | 400/322 |
| 2187582 | 9/1987 | Japan | 400/903 |
| 0267175 | 11/1987 | Japan | 400/903 |

*Primary Examiner*—David A. Wiecking
*Assistant Examiner*—Steven S. Kelley
*Attorney, Agent, or Firm*—Oliff & Berridge

[57] ABSTRACT

A printer including a stepper motor for moving a carriage, a detector for detecting arrival of the carriage at a detection point within a range of the carriage movement, a stop for determining one end of the carriage movement range, and a first setting device operable upon power application to the printer, for activating the motor to move the carriage toward the stop until the carriage arrives at the detection point, and further activating the carriage in the same direction by a predetermined number of steps from the detection point such that the motor is activated without displacement thereof with the carriage held in abutment on the stop for at least the last one step, whereby a zero point of the carriage is established for the first time after the power application. The printer further includes a distance detecting device operable after the establishment of the carriage zero point, for detecting a distance between the stop and the detection point, and a second setting device operable when it is required to establish the carriage zero point for a second and subsequent times after the power application. The second setting device establishes the carriage zero point, based on the distance.

16 Claims, 5 Drawing Sheets

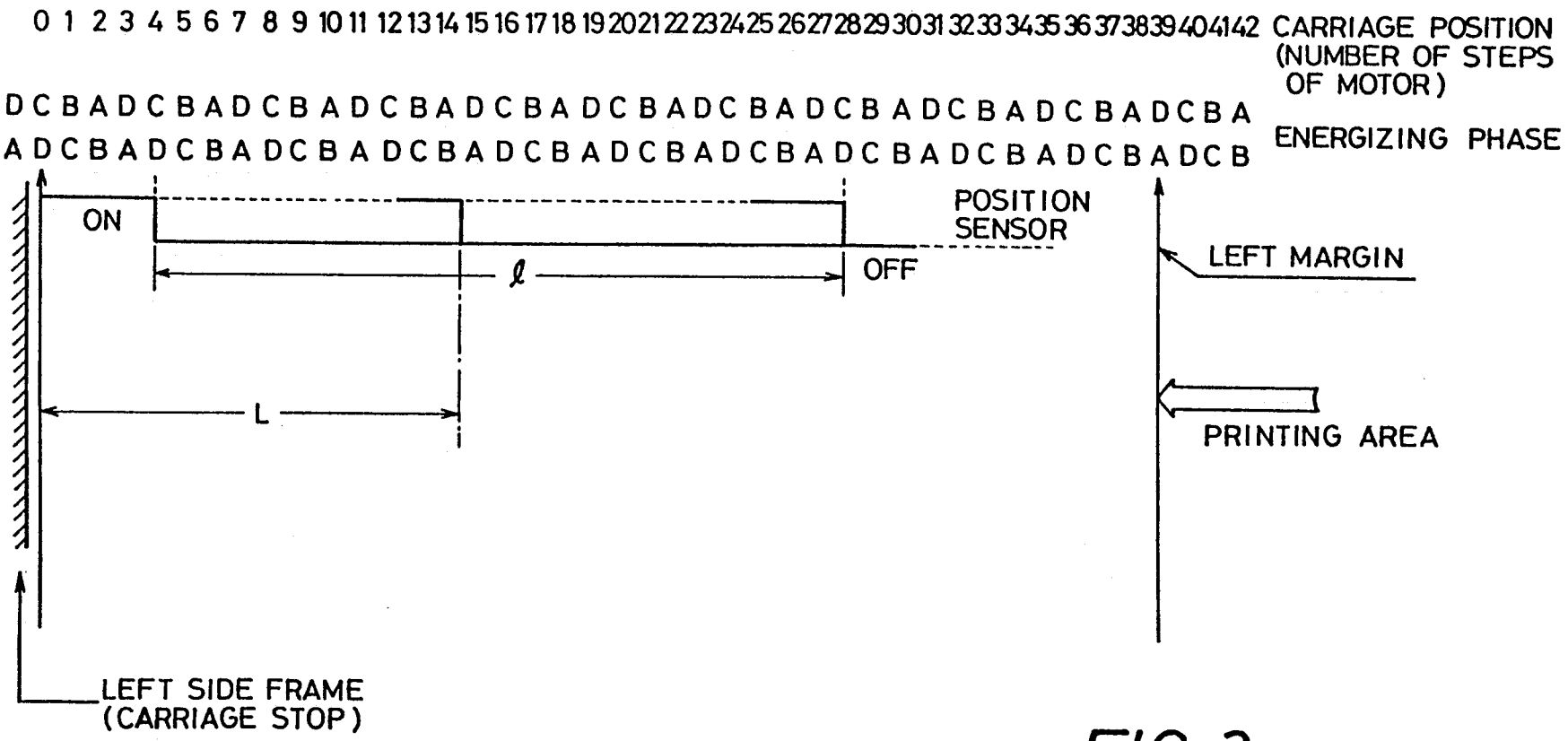
CARRIAGE POSITION (NUMBER OF STEPS OF MOTOR)
ENERGIZING PHASE
0 1 2 3 4 5 6 7 8 9 10 11 12 13 14 15 16 17 18 19 20 21 22 23 24 25 26 27 28 29 30 31 32 33 34 35 36 37 38 39 40 41 42
D C B A D C B A D C B A

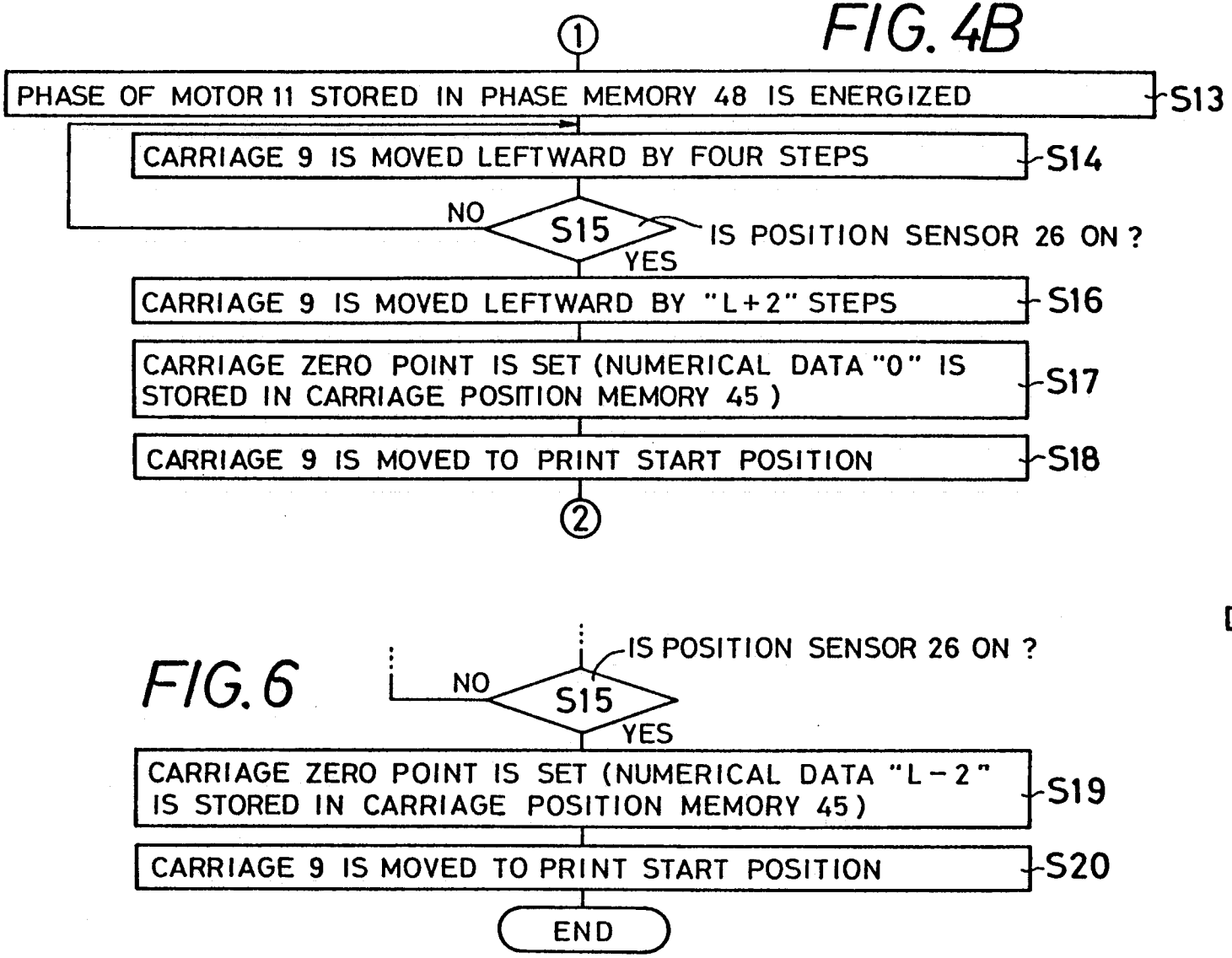
FIG. 4B
1
PHASE OF MOTOR 11 STORED IN PHASE MEMORY 48 IS ENERGIZED
S13
CARRIAGE 9 IS MOVED LEFTWARD BY FOUR STEPS
S14
S15
IS POSITION SENSOR 26 ON ?
YES
NO
CARRIAGE 9 IS MOVED LEFTWARD BY "L+2" STEPS
S16
CARRIAGE ZERO POINT IS SET (NUMERICAL DATA "0" IS STORED IN CARRIAGE POSITION MEMORY 45)
S17
CARRIAGE 9 IS MOVED TO PRINT START POSITION
S18
2
FIG. 6
S15
IS POSITION SENSOR 26 ON ?
YES
NO
CARRIAGE ZERO POINT IS SET (NUMERICAL DATA "L-2" IS STORED IN CARRIAGE POSITION MEMORY 45)
S19
CARRIAGE 9 IS MOVED TO PRINT START POSITION
S20
END

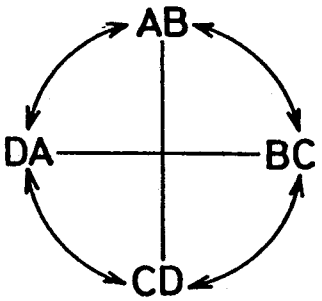
FIG. 5
AB
BC
CD
DA

PRINTER HAVING CARRIAGE ZEROING DEVICE

BACKGROUND OF THE INVENTION

1. Field of the Invention

The present invention relates to a printer incorporating a device for zeroing a carriage which has a print head mounted thereon.

2. Discussion of the Prior Art

There is known a printer of the type indicated above, wherein the home position or zero point of the carriage or a stepper motor to drive the carriage is detected or established upon power application to the printer, by using a zero-point sensor disposed within a range of movement of the carriage. In this first type of carriage zeroing arrangement, the zero-point sensor should be positioned with extremely high accuracy. A second known type of carriage zeroing arrangement uses a carriage stop disposed on a side frame of the printer, so that the carriage is zeroed by energizing the carriage drive stepper motor to move the carriage into abutting contact with the carriage stop and further energizing the motor in a step-out or out-of-synchronization manner, i.e., without an angular or linear displacement thereof with the carriage held in abutting contact with the stop. In this case, the stepper motor should be energized by a relatively large number of steps for zeroing the carriage or stepper motor. Consequently, the carriage zeroing operation produces a large amount of noise. In view of the above drawbacks of the carriage zeroing arrangements, there is known a third type of zeroing arrangement which employs a position sensor for detecting a detection point of the carriage near the carriage stop. In this case the carriage drive stepper motor is energized by a suitable number of steps to move the carriage toward the carriage stop after the detection point of the carriage is detected by the position sensor, so that the carriage drive stepper motor is energized without an angular or linear displacement thereof with the carriage held in abutting contact with the stop. This third type has a relatively large tolerance of positioning error of the position sensor, or permits relatively easy positioning of the position sensor, as compared with the first type wherein the carriage is zeroed only by means of the zero-point sensor indicated above. Further, the third type is advantageous for a relatively short time of out-of-synchronization energization of the stepper motor, as compared with the second type of zeroing arrangement which does not use the position sensor disposed near the carriage stop.

In the third type of carriage zeroing arrangement, the number of energizations of the stepper motor after the carriage detecting point is detected by the position sensor should be a sum of the number of steps which corresponds to a maximum distance between the carriage stop and the position of the position sensor which varies within a given range of positioning tolerance, and a suitable number of additional steps necessary for the out-of-synchronization energization of the stepper motor without its displacement with the carriage held in abutting contact with the carriage stop. If the position sensor is positioned relatively near the carriage stop, the stepper motor is energized by an unnecessarily large amount, and the time of the energization of the motor in the out-of-synchronization manner is unnecessarily long. Accordingly, the printer using the third type of carriage zeroing arrangement suffers from a large amount of carriage zeroing noise due to the energization of the stepper motor with the carriage in abutting contact with the carriage stop.

While the carriage or stepper motor should be zeroed upon application of power to the printer, the carriage zeroing operation is necessary in other situations. For instance, the carriage should be zeroed when a ribbon cassette on the carriage is changed with the top cover of the printer removed, because the previously established zero point of the carriage might be lost. In the light of this situation, the printer is generally adapted to re-establish the zero point of the carriage when the top cover is opened and closed. According to the third type of carriage zeroing arrangement, the carriage zeroing operation upon the closure of the top cover also requires a long period of energization of the stepper motor and suffers from an accordingly large amount of zeroing noise.

SUMMARY OF THE INVENTION

The present invention was developed in the light of the above drawbacks experienced in the prior art. It is therefore an object of the present invention to provide a printer wherein the second and subsequent carriage zeroing operations are effected with a relatively short period of energization of the carriage drive stepper motor or without energization of the motor, after a detection point of the carriage near the carriage stop is detected.

The above object may be achieved according to the principle of the present invention, which provides a printer comprising: (a) a carriage having a print head mounted thereon and movable along a line of printing; (b) a stepper motor for moving the carriage; (c) carriage-position detecting means for detecting arrival of the carriage at a detection point within a range of movement of the carriage; (d) a carriage stop disposed at one of opposite ends of the range of movement of the carriage, for determining the above-indicated one end of the range of movement; (f) first setting means operable upon power application to the printer, for activating the stepper motor to move the carriage in a direction toward the carriage stop until the carriage arrives at the detection point, and further activating the carriage in the direction by a predetermined number of steps from the detection point such that the stepper motor is activated without displacement thereof with the carriage held in abutting contact with the carriage stop for at least the last one of the above-indicated predetermined number of steps, whereby a zero point of the carriage is established for the first time after the power application; (g) distance detecting means operable after the zero point of the carriage is established, for detecting a distance between the carriage stop and the detection point; and (h) second setting means operable when it is required to establish the zero point of the carriage for a second and subsequent times after the power application, for establishing the zero point of the carriage, based on the distance.

In the printer of the present invention constructed as described above, the distance between the carriage stop and the detection point detected by the carriage-position detecting means is calculated or detected by the distance detecting means. When the second or subsequent zeroing of the carriage is effected, the second setting means determines the zero point of the carriage, based on the actually detected distance between the detected detection point and the carriage stop. Therefore, the number of steps of energization of the stepper motor in the out-of-synchronization manner with the carriage held in abutting contact with the carriage stop may be significantly reduced or even eliminated. In the known carriage zeroing arrangement, the second and subsequent zeroing operations following the initial zeroing upon power application to the printer are also effected by the first setting means, which activates the stepper motor by a relatively large number of steps after the detection of arrival of the carriage at the detection point, so that the carriage always reaches the carriage stop, even where the positioning error of the carriage-position detecting means is considerably large. In the instant printer, an unnecessary amount of operation of the stepper motor after the movement of the carriage to the carriage stop can be avoided, since the distance to the carriage stop is known.

Further, the carriage zeroing arrangement according to the invention provides a relatively large positioning tolerance of the carriage-position detecting means, and therefore permits easy positioning or eliminates a fine position adjustment of the detecting means.

In one form of the present invention, the printer is adapted such that after the arrival of the carriage is detected by the carriage-position detecting means, the second setting means activates the stepper motor by a number of steps corresponding to the detected distance, plus a predetermined number of additional steps, so that the carriage is brought into abutting contact with the carriage stop and zeroed.

In another form of the invention, the second setting means establishes the zero point of the carriage by calculating the position of the carriage based on the distance detected by the distance detecting means after the arrival of the carriage is detected by the carriage-position detecting means. In this case, it is not necessary to move the carriage into abutting contact with the carriage stop.

In a further form of the invention, the carriage-position detecting means includes a sensor which is disposed such that a position of the sensor relative to the carriage stop may fluctuate. The sensor has a first state in which the sensor generates an OFF signal and a second state in which the sensor generates an ON signal. The sensor is switched from the first state to the second state when the carriage arrives at the detection point while the carriage is moved in the direction toward the carriage stop, and switched from the second state to the first state when the carriage arrives at the detection point while the carriage is moved in a direction away from the carriage stop. In this case, the carriage-position detecting means detects the arrival of the carriage when the sensor is switched from the first state to the second state or vice versa.

In a still further form of the invention, the first setting means determines whether the carriage-position detecting means has detected the arrival of the carriage, each time the stepper motor is activated in an energization cycle which begins with a predetermined reference energizing phase, and when the carriage-position detecting means has detected the arrival of the carriage, the first setting means activates the stepper motor by a predetermined number of energization cycles sufficient to bring the carriage into abutting contact with the carriage stop, and then stores in a carriage position memory carriage zero point data indicative of the zero point.

According to one feature of the above form of the invention, the carriage zero point data initially stored in the carriage position memory is indicative of a numerical value "0", and the distance detecting means activates the stepper motor in increments of one step to move the carriage in the direction away from the carriage stop, while incrementing the content of the carriage position memory. In this case, the distance detecting means includes a distance memory which stores as data indicative of the distance, the content of the carriage-position memory at the time when the carriage-position detecting means has detected the arrival of the carriage. The distance detecting means further includes an energizing phase memory which stores phase data indicative of a related energizing phase of the stepper motor which has a predetermined relation with a detected energizing phase of the motor when the arrival of the carriage is detected.

According to another feature of the above form of the invention, the related energizing phase of the stepper motor is furthest from the detected energizing phase in opposite operating directions of the motor.

According to a further feature of the same form of the invention, the related energizing phase is at least two steps away from the detected energizing phase in the operating direction of the stepper motor to move the carriage in the direction toward the carriage stop.

According to a still further feature of the same form of the invention, the second setting means determines whether the carriage-position detecting means has detected the arrival of the carriage, each time the stepper motor is activated in an energization cycle which begins with the related energizing phase stored in the phase memory in an operating direction to move the carriage toward the carriage stop, and when the carriage-position detecting means has detected the arrival of the carriage, the second setting means further activates the stepper motor by the number of steps corresponding to the distance stored in the distance memory, plus at least one additional step smaller than a number of steps corresponding to the energization cycle, whereby the carriage is brought into abutting contact with the carriage stop. The second setting means subsequently stores the numerical value "0" in the carriage position memory as the carriage zero point data. In this case, the energizing cycle may consist of four energizing phases, and the related energizing phase may be determined so that it is two phases away from the detected energizing phase. In this instance, the above-indicated at least one additional step consists of two steps.

In a yet further form of the present invention, the second setting means determines whether the carriage-position detecting means has detected the arrival of the carriage, each time the stepper motor is activated in an energization cycle beginning with the related energizing phase stored in the phase memory in an operating direction to move the carriage toward the carriage stop, and when the carriage-position detecting means has detected the arrival of the carriage. The second setting means stores in the carriage position memory the number of steps corresponding to the distance stored in the distance memory, minus a number of steps between the related and detected energizing phases. In this case, too, the energizing cycle may consist of four energizing phases, and the related energizing phase may be two phases away from the detected energizing phase.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which:

FIG. 3 is a view explaining a carriage zeroing operation of the printer;

FIGS. 4A and 4B are flow charts illustrating one example of a control program for the carriage zeroing operation, which is stored in a read-only memory of the control system of FIG. 2;

FIG. 5 is an illustration showing energizing phases of a carriage drive stepper motor; and FIG. 6 is a flow chart showing a modified control program for the carriage zeroing operation, according to another embodiment of the invention.

DETAILED DESCRIPTION OF THE PREFERRED EMBODIMENTS

Figure 1:
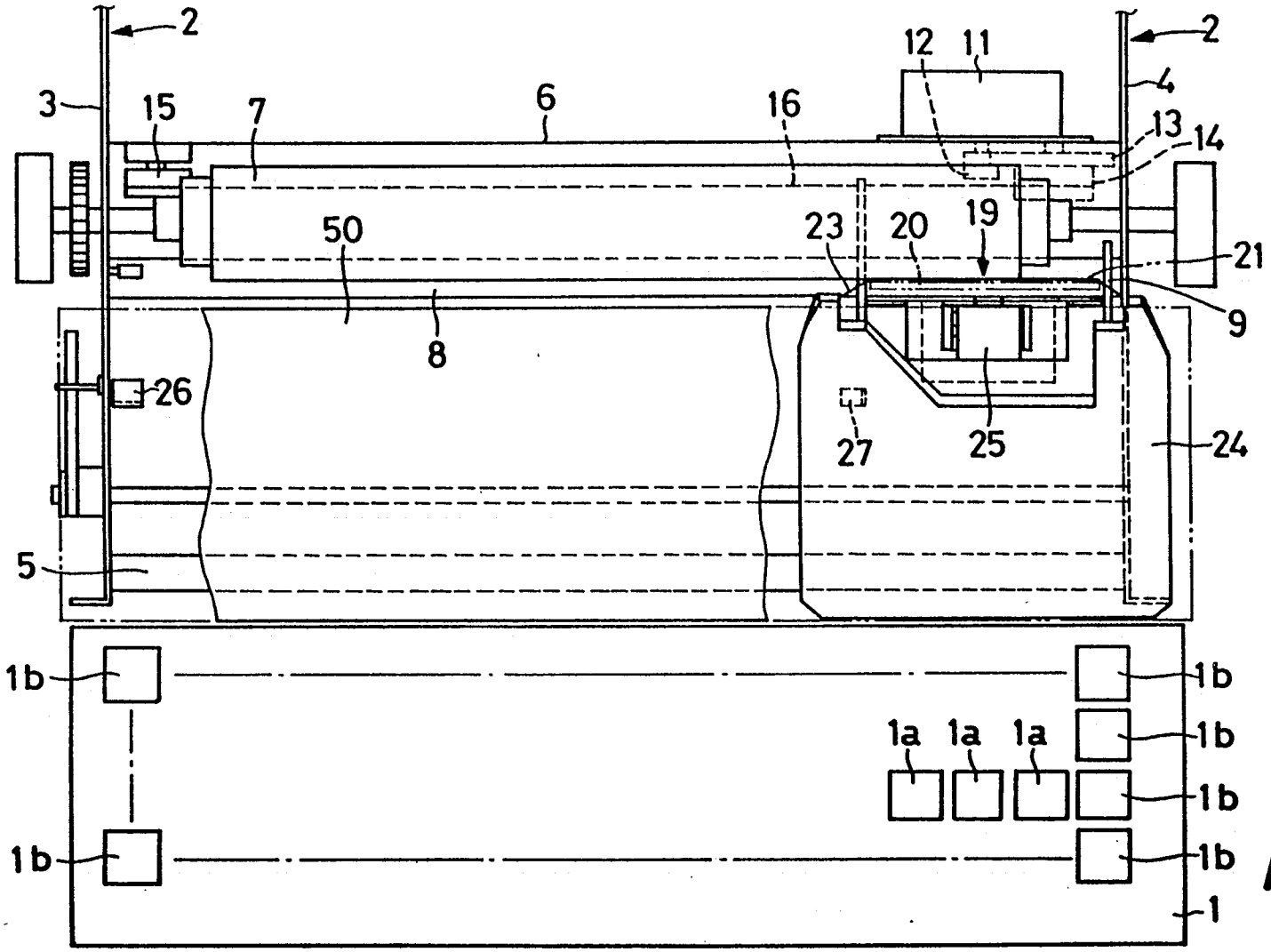
FIG. 1 is a schematic plan view of a printer to which the present invention is applied.

Referring first to the schematic plan view of FIG. 1 of the preferred embodiment of the printer of the invention, the printer has a keyboard 1 in its front portion, and a frame structure 2 which includes a left and a right side frame 3, 4. These side frames 3, 4 are connected to each other by a pair of fixed connecting members 5, 6 that extend therebetween behind the keyboard 1. Above the rear connecting member 6, there is disposed a platen 7 rotatably supported between the side frames 3, 4. A guide rod 8 is secured to the side frames 3, 4 so as to extend therebetween parallel to the platen 7. The guide rod 8 supports a carriage 9 at its rear portion, such that the carriage 9 is slidably moved parallel to the platen 7. The carriage 9 is formed of a metal plate by bending thereof. The carriage 9 is slidably supported at its front portion by the front connecting member 5.

To a right-hand side portion of the rear surface of the rear connecting member 6, there is attached a four-phase stepper motor 11 for driving the carriage 9. The connecting member 6 incorporates a drive pulley 14 which is driven by the stepper motor 11 via a drive gear 12 and a driven gear 13. The drive pulley 14 is connected to a driven pulley 15 rotatably mounted on the left side frame 3, by a connecting wire 16 which is fixed at a portion thereof to the carriage 9. With the drive pulley 14 rotated by the stepper motor 11, the carriage 9 is moved along the platen 7, through the driven pulley 15 and wire 16.

The left side frame 3 serves as a carriage stop for limiting a leftward movement of the carriage 9, namely, for determining the left-hand side end of the carriage movement. On the left side frame 3, there is fixed a position sensor 26 as carriage-position detecting means for detecting arrival of the carriage 9 at a detection point which is away from the left side frame or carriage stop 3. While the position of the position sensor 26 in the direction of movement of the carriage 7 fluctuates due to positioning error of the sensor 26, the sensor 26 can confirm that the carriage 9 is positioned within a predetermined area away from the carriage stop 3. The , carriage 9 has a print head 19 mounted thereon. The print head 19 includes a print wheel 20 which has a multiplicity of type fonts 21 corresponding to different characters, and a print hammer 25. The carriage 9 is adapted to support a ribbon cassette 24 in which an ink ribbon 23 is accommodated. The carriage 9 further has an operating tab 27 provided on its underside, so that the tab 27 actuates the position sensor 26, or brings the sensor 26 to its ON state, during movement of the carriage 9 toward the left side frame 3.

Figure 2:
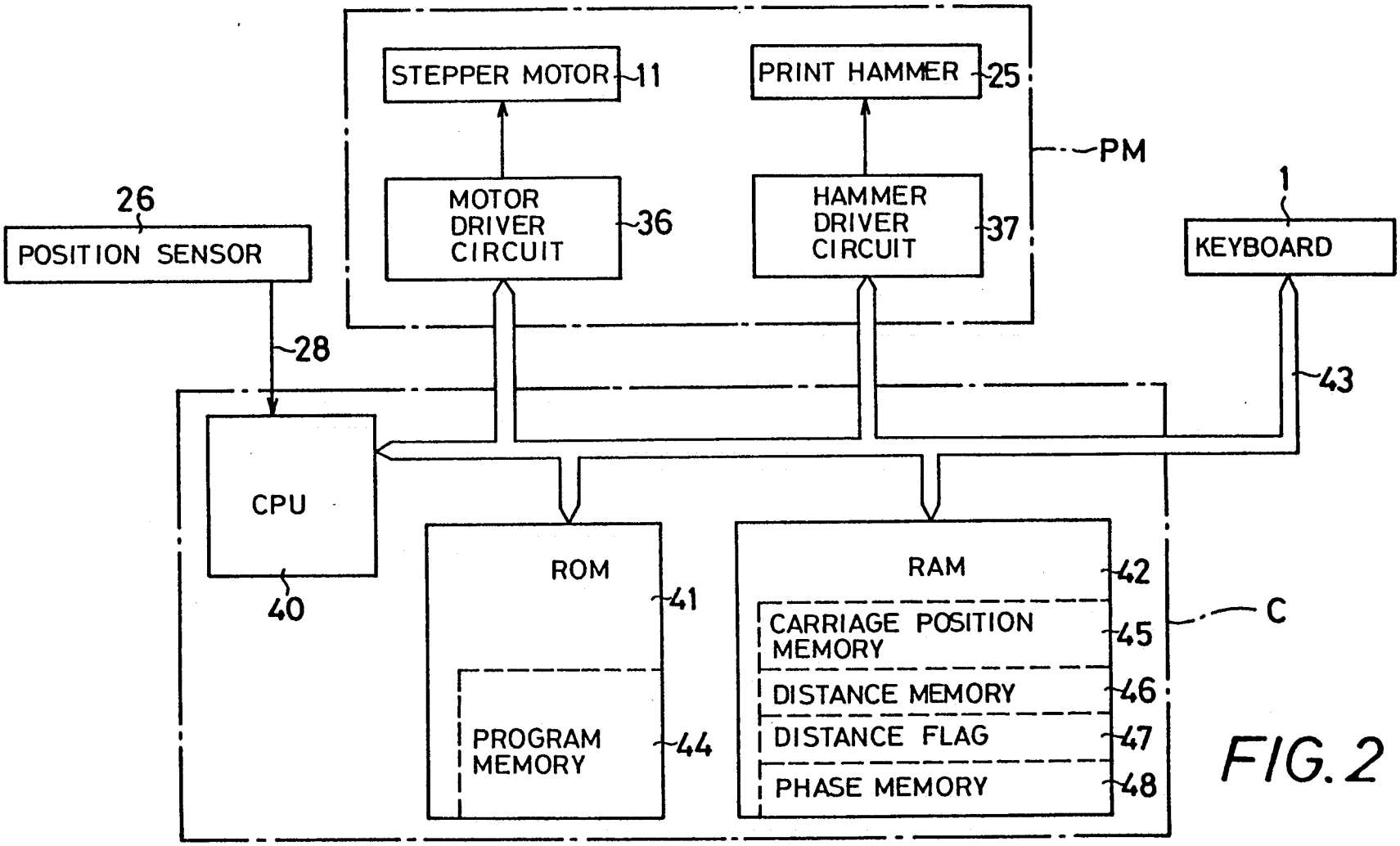
FIG. 2 is a schematic block diagram of a control system of the printer of FIG. 1 according to one embodiment of the invention.

Referring next to the block diagram of FIG. 2, there is shown a control system for the printer, major components of which consist of the keyboard 1, a printing mechanism PM and a control .device C. The printing mechanism PM and the keyboard 1 are connected to a central processing unit (CPU) 40 of the control device C, via a data bus 43. As described below, the control device C serves as first setting means, second setting means and distance detecting means, which are provided to practice the principle of the present invention.

The printing mechanism PM includes at least the stepper motor 11, a driver circuit 36 to drive the motor 11, the print hammer 25, and a driver circuit 37 to drive the print hammer 25. The control device C includes the CPU 40, and a read-only memory (ROM) 41 and a random-access memory (RAM) 42 which are connected to the CPU 40 via the data bus 43.

The ROM 41 includes a program memory 44 which stores various control programs such as a program for controlling the printing mechanism PM according to coded data entered through character keys 1*a* and various function keys 1*b* on the keyboard 1, and a program for establishing the zero point of the carriage 9 or stepper motor 11. The RAM 42 includes a CARRIAGE POSITION memory 45, a DISTANCE memory 46, a DISTANCE flag 47, and a PHASE memory 48, as well as various memories for temporarily storing results of arithmetic operations by the CPU 40 for controlling the printing mechanism PM. The CARRIAGE POSITION memory 45 stores position data indicative of the current position of the carriage 9. The DISTANCE memory 46 stores distance data indicative of the number of steps of the stepper motor 11 which corresponds to a distance L between the carriage stop 3 (left side frame 3) and the position sensor 26, which distance data is utilized for establishing the zero point of the carriage 9. The DISTANCE flag 47 stores data which indicates that the distance data is stored in the DISTANCE memory 46. The PHASE memory 48 stores phase data indicative of a specific energizing phase of the stepper motor 11, which phase data is used for establishing the zero point of the carriage 9. In FIG. 3, the position data stored in the CARRIAGE POSITION MEMORY 45 is indicated as "0", "1", "2", . . . "n" which represents the number of steps of the stepper motor 11 necessary to move the carriage 9 from the carriage stop 3 to the current position of the carriage 9.

The ON and OFF signals generated by the position sensor 26 are applied to the CPU 40, as indicated at 28 in FIG. 2.

Referring to FIGS. 3, 4A, 4B and 5, there will be described the operation of the control device C for detecting or establishing the zero point of the carriage 9.

When the carriage 9 is moved in the leftward direction, the stepper motor 11 is activated by repeating simultaneous two-pole energization cycles, each cycle consisting of a phase AB, a phase BC, a phase CD and a phase DA which occur in the order of description.

When the carriage 9 is moved in the rightward direction, the energization cycle occurs in the reverse direction, namely, in the order of the phase DA, phase CD, phase BC and phase AB.

Figure 4A:
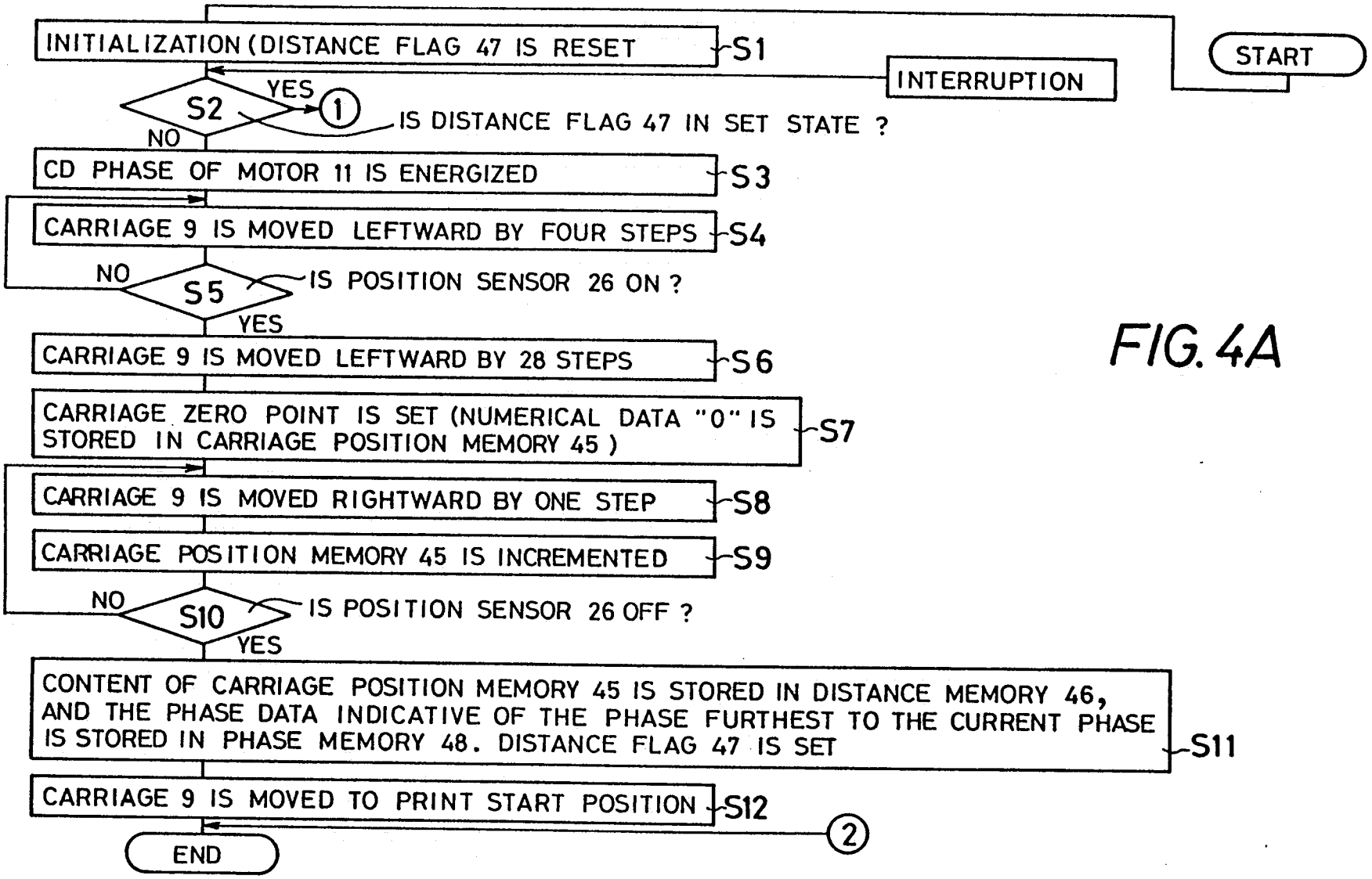

Upon power application to the printer, the control program illustrated in FIG. 4A is started. Initially, the control flow goes to step S1 in which the control device C is initialized. The initializing operations include the resetting of the DISTANCE flag 47. Then, the control flow goes to step S2 to determine whether the DISTANCE flag 47 is in the set state or not. When the carriage 9 is zeroed for the first time after the printer is turned on, the DISTANCE flag 47 is in the reset state, whereby a negative decision (NO) is obtained in step S2. Consequently, the control flow goes to step S3. In this step S3, the CD phase of the stepper motor 11 is energized.

Steps S4–S7 following step S3 are executed to detect or establish the zero point of the carriage 9. In step S4, the stepper motor 11 is activated by four steps beginning with the energization of DA phase following the CD phase, to move the carriage 9 leftward toward the carriage stop 3. Then, step S5 is executed to determine whether the position sensor 26 is in the ON state or not. Steps 4 and 5 are repeatedly executed to move the carriage 9 leftward by four steps for each energizing cycle (step S4), until an affirmative decision (YES) is obtained in step S5, that is, until the position sensor 26 is changed from the OFF state to the ON state. Then, the control flow goes to step S6 in which the stepper motor 11 is energized by 28 steps, to move the carriage 9 leftward.

In the present embodiment, the position sensor 26 may be positioned over a relatively wide area along the platen 7, as indicated at l in FIG. 3. In other words, there is a relatively large tolerance of the positioning error of the position sensor 26. Described more specifically, the permissible positioning area l of the position sensor 26 is set between the left margin position and the left side frame or carriage stop 3, for example, over an approximately 4–5 mm distance of movement of the carriage 9 along the platen 7. In this specific example, the permissible area l corresponds to 23 steps of the stepper motor 11 (which corresponds to about 4.9 mm movement of the carriage 9), and the left end of the area is spaced apart from the carriage stop 3 by four steps of the motor 11 and therefore the right end of the area is spaced apart from the carriage stop 3 by 28 steps. According to this arrangement, if the position sensor 26 is positioned approximate to the right end (carriage position No. 28 as indicated in FIG. 3) within the permissible area l, the position sensor 26 is turned ON (step S5) at the carriage position No. 24 in which the phase CD of the stepper motor 11 is energized at the end of the appropriate energizing cycle. Therefore, the stepper motor 11 is activated by four steps even after the carriage 9 reaches the carriage stop 3. Namely, with the stepper motor 11 activated by 28 steps in step S6, the stepper motor 11 is activated by four steps in the step-out or out-of-synchronization manner without an angular displacement thereof, while the carriage 9 is held in abutting contact with the carriage stop 3. If the position sensor 26 is positioned at the left end (carriage position No. 4) of the permissible area l, the sensor 26 is turned ON at the carriage position No. 4, and the stepper motor 11 is activated by 24 steps in the out-of-synchronization manner without an angular displacement thereof with the carriage 9 held in abutting contact with the carriage stop 3 when the stepper motor 11 is energized by 28 steps in step S6. Thus, the carriage 9 (stepper motor 11) can be zeroed even if the position of the position sensor 26 varies due to the positioning error over the permissible positioning area l. It will be understood that the number of energizing steps by which the motor 11 is activated in the out-of-synchronization manner at the zero point (carriage position No. 0) of the carriage 9 varies depending upon the position of the position sensor 26.

Following step S6, step S7 is executed to store numerical data "0" in the CARRIAGE POSITION memory 45, and thereby establish the zero point of the carriage 9. In this condition, the phase CD of the stepper motor 11 is energized.

Usually, the position sensor 26 is positioned in an almost central part of the permissible area l. If the position sensor 26 is positioned between the carriage position Nos. 14 and 15 as indicated in FIG. 3, the sensor 26 is turned ON in step S5 when the carriage 9 reaches the carriage position No. 12 (corresponding to the phase CD) during its leftward movement toward the carriage stop 3 by the repeated execution of step 34. In step S6, therefore, the carriage 9 reaches the carriage stop 3 by the 12-step energization of the stepper motor 11 after the position sensor 26 is turned ON, and the stepper motor 11 is activated by the remaining 16-step energization of the motor 11 in the out-of-synchronization manner at the carriage position 0.

Steps S8–S11 following step S7 are provided to calculate a distance L between the carriage stop 3 and the position sensor 26, which distance L is utilized for effecting a second and subsequent zeroing operations of the carriage 9 which will be described. In step S8, the stepper motor 11 is energized by one step to move the carriage 9 in the rightward direction. The control flow then goes to step S9 in which the content of the CARRIAGE POSITION memory 45 is incremented. Step S9 is followed by step S10 to determine whether the position sensor 26 is turned OFF or not. If a negative decision (NO) is obtained in step S10, steps S8–S10 are repeated. If an affirmative decision (YES) is obtained in step S10, i.e., if the position sensor 26 is turned OFF, the control flow goes to step S11 in which the current content of the CARRIAGE POSITION memory 45 is stored in the DISTANCE memory 46 as the distance data indicative of the distance L between the carriage stop 3 and the position sensor 26. Further, the DISTANCE flag 47 is placed in the set state, and data indicative of the phase of the stepper motor 11 (hereinafter referred to as "related phase" of the motor 11) which is furthest to the currently established phase is stored in the PHASE memory 48 as the phase data.

The above-indicated related phase of the motor 11 which is furthest to the currently established phase (phase which is detected when the position sensor 26 is turned OFF), is interpreted to mean the phase which is diametrically opposite to the currently established phase, where the phase rotation is expressed as illustrated in FIG. 5. More particularly, the energizing cycle of the stepper motor 11 may be schematically shown such that the phases AB, BC, CD and DA are arranged on a circle, in equally circumferentially spaced-apart relation with each other. In this schematic diagram, the related phase furthest to the phase DA for example is the phase BC which is positioned opposite to the phase DA, or which is furthest to the phase DA in the opposite circumferential directions.

In the example described above wherein the position sensor 26 is positioned between the carriage position Nos. 14 and 15, the position sensor 26 is turned OFF (step S10) when the carriage 9 reaches the carriage position No. 15 during the incremental movement in the rightward direction (through the repeated execution of steps S8–S10). In this condition, the distance data L to be stored in the DISTANCE memory 46 in step S11 is "15". Further, the phase DA of the stepper motor 11 corresponding to the carriage position No. 15 is currently energized or established. Therefore, the related phase to be stored in the PHASE memory 48 in step S11 is the phase BC, which is furthest to the currently established phase DA as viewed in FIG. 5.

Step S11 is followed by step S12 in which the carriage 9 is moved rightward to the print start position, namely, to the left margin position of the printer. In the present specific embodiment, the left margin is positioned at the carriage position No. 39, i.e., 39 steps away from the carriage stop 3. Accordingly, the carriage 9 reaches the left margin position as a result of energization of the stepper motor 11 by (39−L) steps.

The significance of the above-described steps S8–S11 will be described. That is, it becomes necessary to reestablish the zero point of the carriage 9 when the top cover 50 of the printer is opened and closed after the printer is initially turned on. The opening and closure of the top cover indicates a possibility of replacement of the ribbon cassette 24, for example, which requires that the carriage 9 be zeroed again. Therefore, when the top cover of the printer is opened and closed, the control flow goes to step S2 by means of interruption. In this second or subsequent carriage zeroing operation upon opening and closing of the top cover after the printer is turned on, an affirmative decision (YES) is obtained in step S2, since the DISTANCE flag 47 has already been set in step S11. Consequently, the control flow goes to step S13 wherein the related phase of the stepper motor 11 designated by the phase data stored in the PHASE memory 48 is energized. In the above example, the phase BC is energized. In the next step S14, the carriage 9 located at a given position along the platen 7 is moved leftward by repeated energizing cycles of the stepper motor 11, each cycle consisting of four steps (phases BC, CD, DA and AB). Step S14 is followed by step S15 to determine whether the position sensor 26 is turned ON or not. These steps S14 and S15 are identical with steps S4 and S5 which have been described. When the position sensor 26 is turned ON, step S16 is executed to activate the stepper motor 11 by (L+2) steps to further move the carriage 9 in the leftward direction. In the above example, the position sensor 26 is turned ON when the carriage 9 reaches the carriage position No. 13 which corresponds to the phase BC which occurs for the first time after the arrival of the carriage 9 at the detection point between the carriage position Nos. 14 and 15. Further, the distance data L stored in the DISTANCE memory 46 is "15". Accordingly, the carriage 9 is moved leftward by (15+2) steps from the carriage position No. 13, whereby the stepper motor 11 is activated by only four steps in the out-of-synchronization manner without an angular displacement thereof with the carriage 9 held in abutting contact with the carriage stop 3. Thus, the number of energizing steps of the stepper motor 11 in the out-of-synchronization manner at the carriage position No. 0 is considerably reduced in the second or subsequent carriage zeroing operation, as compared with that in the first carriage zeroing operation upon power application to the printer, wherein the stepper motor 11 is activated by 4–24 steps in the out-of-synchronization manner, depending upon the position of the position sensor 26 within the permissible range l. This is an advantage offered by the present embodiment of the invention.

Then, the control flow goes to step S17 wherein the zero point of the carriage 9 is established or set as in step S7. Namely, the numerical data "0" is stored in the CARRIAGE POSITION memory 45. Step S17 is followed by step S18 to move the carriage 9 to the print start position (left margin position of the printer). Thus, the interruption routine for the second or subsequent carriage zeroing operation (S2, S13–S18) is terminated.

It will be understood from the foregoing description that the second or subsequent carriage zeroing operation after the power application is effected such that the stepper motor 11 is activated by (L+2) steps after the position sensor 26 is turned ON, where L represents the number of steps corresponding to the distance L between the carriage stop 3 (zero point or carriage position No. 0) and the position sensor 26. This means only one energization cycle of the stepper motor 11 in the out-of-synchronization manner while the carriage 9 is held at the carriage position No. 0 or in abutting contact with the carriage stop 3.

While the above embodiment of the invention is adapted to effect the second or subsequent carriage zeroing operation such that the carriage 9 is brought into abutting contact with the carriage stop 3 (step S16) after the position sensor 26 is turned ON (step S15), it is possible that the second or subsequent carriage zeroing operation is performed as shown in FIG. 6, wherein the carriage 9 is zeroed by calculating the position of the carriage 9 based on the distance L which is detected after the arrival of the carriage 9 at the detection point by the position sensor 26, as described blow.

In this modified embodiment of FIG. 6, steps S16–S18 of the preceding embodiment of FIG. 4 are replaced by steps S19 and S20. In step S19, the content of the CARRIAGE POSITION memory 45 at the time the position sensor 26 is turned ON in step S15 is replaced by (L−2). In the specific example indicated above, the carriage 9 is located at the carriage position No. 13 when the position sensor 26 is turned ON as described above. Further, the distance L corresponds to 15 steps of energization of the stepper motor 11. Therefore, the position data (L−2) stored in the CARRIAGE POSITION memory 45 represents 13 steps of energization of the stepper motor 11, which represents the carriage position No. 13. This results in the same effect as provided in the preceding embodiment, i.e., the carriage 9 is correctly zeroed by storing the position data (L−2) in the CARRIAGE POSITION memory 45. In the next step S20, the carriage 9 is moved rightward by (39−L+2) steps, whereby the carriage 9 reaches the left margin position or print start position of the printer.

In the above embodiment, the second or subsequent carriage zeroing operation is effected such that the carriage 9 is moved to the print start position immediately after the position sensor 26 is turned ON. Accordingly, there is no noisy energization of the stepper motor 11 in the out-of-synchronization manner with the carriage 9 held in abutting contact with the carriage stop 3 at the carriage position No. 0, whereby the overall carriage zeroing time is significantly reduced.

Although the second embodiment of FIG. 6 is advantageous over the first embodiment of FIG. 4 in the sense indicated in the preceding paragraph, the first embodiment is significant in that the return movement of the carriage 9 into abutting contact with the carriage stop 3 after the position sensor 26 is turned ON in the case of the second or subsequent zeroing operation informs the operator that the carriage 9 is correctly zeroed after the top cover of the printer is closed, as in the case of the first carriage zeroing operation upon power application to the printer.

While the present invention has been described in its presently preferred embodiments with a certain degree of particularity, it is to be understood that the invention is not limited to the precise details of the illustrated embodiments, but may be embodied with various changes, modifications and improvements, which may occur to those skilled in the art, without departing from the spirit and scope of the invention defined in the following claims.

What is claimed is:

1. A printer comprising:

a carriage having a print head mounted thereon and movable along a line of printing;

a stepper motor for moving the carriage;

carriage-position detecting means for detecting arrival of the carriage at a detection point within a range of movement of the carriage;

a carriage stop disposed at one of opposite ends of said range of movement of the carriage, for determining said one end of said range of movement;

first setting means operable upon power application to the printer, for activating said stepper motor to move said carriage in a direction toward said carriage stop until the carriage arrives at said detection point, and further activating the carriage in said direction by a first predetermined number of steps from said detection point such that the stepper motor is activated without displacement thereof with the carriage held in abutting contact with said carriage stop for at least a last one of said first predetermined number of steps, whereby a zero point of the carriage is established for the first time after said power application;

distance detecting means operable after said zero point of the carriage is established, for detecting a distance between said carriage stop and said detection point by activating said stepper motor to move said carriage in a direction opposite to said direction toward said carriage stop and counting a number of steps needed for moving said carriage from said carriage stop to said detection point;

said distance detecting means including a distance memory for storing data indicative of the counted number of steps representing said distance between said carriage stop and said detection point; and second setting means operable when it is required to establish the zero point of the carriage for a second and subsequent times after said power application, for activating said stepper motor to move the carriage in said direction toward said carriage stop until the carriage arrives at said detection point, and further activating the carriage from said detection point in said direction toward said carriage stop by a sum of said counted number of steps stored in said distance memory and a second predetermined number of additional steps which number is smaller than said first predetermined number, so that the stepper motor is activated without displacement thereof with the carriage held in abutting contact with said carriage stop for at least a last one of the summed number of steps, whereby the zero point of the carriage is established.

2. A printer according to claim 1, wherein said carriage-position detecting means includes a sensor which is disposed such that a position of the sensor relative to said carriage stop may fluctuate, said sensor having a first state in which the sensor generates an OFF signal and a second state in which the sensor generates an ON signal, said sensor changing from said first state to said second state when the carriage arrives at said detection point while the carriage is moved in said direction toward said carriage stop, and changing from said second state to said first state when the carriage arrives at said detection point while the carriage is moved in the opposite direction away from said carriage stop, said carriage-position detecting means detecting said arrival of the carriage when said sensor changes from said first state to said second state o vice versa.

3. A printer according to claim 1, wherein said first setting means determines whether said carriage-position detecting means has detected said arrival of the carriage, each time said stepper motor is activated in an energization cycle which begins with a predetermined reference energizing phase, and when said carriage-position detecting means has detected said arrival of the carriage, said first setting means activates said stepper motor by a predetermined number of energization cycles sufficient to bring the carriage into abutting contact with said carriage stop, and then stores in a carriage position memory carriage zero point data indicative of said zero point.

4. A printer according to claim 3 wherein said carriage zero point data initially stored in said carriage position memory is indicative of a numerical value "0", and said distance detecting means activates said stepper motor in increments of one step to move the carriage in the opposite direction away from said carriage stop, while incrementing the content of said carriage position memory, said a distance memory which stores as said data indicative of said distance, the content of said carriage-position memory at the time when said carriage-position detecting means has detected said arrival of the carriage, said distance detecting means further including an energizing phase memory which stores phase data indicative of a related energizing phase of the stepper motor which has a predetermined relation with a detected energizing phase of the motor when said arrival of the carriage is detected.

5. A printer according to claim 4, wherein said related energizing phase of the stepper motor is furthest from said detected energizing phase in opposite operating directions of the motor.

6. A printer according to claim 4, wherein said related energizing phase is at least two steps away from said detected energizing phase in the operating direction of the stepper motor to move the carriage in the direction toward said carriage stop.

7. A printer according to claim 4, wherein said second setting means determines whether said carriage-position detecting means has detected said arrival of the carriage, each time said stepper motor is activated in an energization cycle which begins with said related energizing phase stored in said phase memory in an operating direction to move the carriage toward said carriage stop, and when said carriage-position detecting means has detected said arrival of the carriage, said second setting means further activates said stepper motor by a number of steps corresponding to said distance stored in said distance memory, plus at least one additional step smaller than a number of steps corresponding to said energization cycle, whereby the carriage is brought into abutting contact with said carriage stop, said second setting means subsequently stores said numerical value "0" in said carriage position memory as said carriage zero point data.

8. A printer according to claim 7, wherein said energizing cycle consists of four energizing phases, and said related energizing phase is two phases away from said detected energizing phase, said at least one additional step consisting of two steps.

9. A printer comprising:

a carriage having a print head mounted thereon and movable along a line of printing;

a stepper motor for moving the carriage;

carriage-position detecting means for detecting arrival of the carriage at a detection point within a range of movement of the carriage;

a carriage disposed at one of opposite ends of said range of movement of the carriage, for determining said one end of said range of movement;

first setting means operable upon power application to the printer, for activating said stepper motor to move said carriage in a direction toward said carriage stop until the carriage arrives at said detection point, and further activating the carriage in said direction by a first predetermined number of steps from said detection point such that the stepper motor is activated without displacement thereof with the carriage held in abutting contact with said carriage stop for at least a last one of said first predetermined number of steps, whereby a zero point of the carriage is established for the first time after said power of application;

distance detecting means operable after said zero point of the carriage is established, for detecting a distance between said carriage stop and said detection point by activating said stepper motor to move said carriage in a direction opposite to said direction toward said carriage stop and counting a number of steps needed for moving said carriage from said carriage stop to said detection point;

said distance detecting means including a distance memory for storing data indicative of the counted number of steps representing said distance between said carriage stop and said detection point; and second setting means operable when it is required to establish the zero point of the carriage for a second and subsequent times after said power application, for activating said stepper motor to move the carriage in said direction toward said carriage stop and, when the carriage arrives at said detection point, determining a current position of the carriage such that said current position coincides with said counted number of steps stored in said distance memory, without further activating the carriage in said direction toward said carriage stop, whereby the zero point of the carriage is established.

10. A printer according to claim 9, wherein said carriage-position detecting means includes a sensor which is disposed such that a position of the sensor relative to said carriage stop may fluctuate, said sensor having a first state in which the sensor generates an OFF signal and a second state in which the sensor generates an ON signal, said sensor changing from said first state to said second state when the carriage arrives at said detection point while the carriage is moved in said direction toward said carriage stop, and changing from said second stage to said first state when the carriage arrives at said detection point while the carriage is moved in the opposite direction away from said carriage stop, said carriage-position detecting means detecting said arrival of the carriage when said sensor changes from said first state to said second state or vice versa.

11. A printer according to claim 9, wherein said first setting means determines whether said carriage-position detecting means has detected said arrival of the carriage, each time said stepper motor is activated in an energization cycle which begins with a predetermined reference energizing phase, and when said carriage-position detecting means has detected said arrival for the carriage, said first setting means activates said stepper motor by a predetermined number of energization cycles sufficient to bring the carriage into abutting contact with said carriage stop, and then stores in a carriage position memory carriage zero point data indicative of said zero point.

12. A printer according to claim 11, wherein said carriage zero point data initially stored in said carriage position memory is indicative of a numerical value "0", and said distance detecting means activates said stepper motor in increments of one step to move the carriage in the opposite direction away from said carriage stop, while incrementing the content of said carriage position memory, said distance memory storing as said data indicative of said distance, the content of said carriage-position memory at the time when said carriage-position detecting means has detected said arrival of the carriage, said distance detecting means further including an energizing phase memory which stores phase data indicative of a related energizing phase of the stepper motor which has a predetermined relation with a detected energizing phase of the motor when said arrival of the carriage is detected.

13. A printer according to claim 12, wherein said related energizing phase of the stepper motor is furthest from said detected energizing phase in opposite directions of the motor.

14. A printer according to claim 12, wherein said related energizing phase is at least two steps away from said detected energizing phase in the operating direction of the stepper motor to move the carriage in the direction toward said carriage stop.

15. A printer according to claim 11, wherein said second setting means determines whether said carriage-position detecting means has detected said arrival of the carriage, each time said stepper motor is activated in an energization cycle beginning with said related energizing phase stored in said phase memory in an operating direction to move the carriage toward said carriage stop, and when said carriage-position detecting means has detected said arrival of the carriage, said second setting means establishes said zero point of the carriage by storing in said carriage position memory said counted number of steps corresponding to said distance stored in said distance memory, minus a number of steps between said related and detected energizing phases.

16. A printer according to claim 15, wherein said energizing cycle consists of four energizing phases, and said related energizing phase is two phases away from said detected energizing phase.

* * * * *